US006244016B1

(12) United States Patent
Wolf

(10) Patent No.: US 6,244,016 B1
(45) Date of Patent: Jun. 12, 2001

(54) PREFABRICATED WALL PANEL

(76) Inventor: Johann Wolf, Schonenbuhl 6, CH-9050 Appenzell (CH)

( * ) Notice: Subject to any disclaimer, the term of this patent is extended or adjusted under 35 U.S.C. 154(b) by 0 days.

(21) Appl. No.: 09/544,603

(22) Filed: Apr. 6, 2000

(30) Foreign Application Priority Data

Apr. 7, 1999 (AT) ..... 609/99

(51) Int. Cl.[7] ..... E04C 2/34
(52) U.S. Cl. ..... 52/790.1; 52/654.1; 52/656.1
(58) Field of Search ..... 52/650.2, 654.1, 52/167.3, 236.3, 236.6, 236.7, 693, 656.1, 790.1

(56) References Cited

U.S. PATENT DOCUMENTS

| | | | | |
|---|---|---|---|---|
| 2,475,103 | * | 7/1949 | Mannist | 52/654.1 |
| 3,304,675 | * | 2/1967 | Graham-Wood et al. | 52/236.6 |
| 4,281,491 | | 8/1981 | Schonert . | |
| 5,333,426 | * | 8/1994 | Varoglu | 52/236.7 |
| 5,566,523 | * | 10/1996 | Ozanne | 52/654.1 |
| 5,987,841 | * | 11/1999 | Campo | 52/236.3 |

FOREIGN PATENT DOCUMENTS

| | | |
|---|---|---|
| 25 19 469 | 10/1976 | (DE) . |
| 2 650 611 | 2/1991 | (FR) . |

* cited by examiner

*Primary Examiner*—Michael Safavi
(74) *Attorney, Agent, or Firm*—Young & Thompson

(57) ABSTRACT

A prefabricated wall panel for wood structures has a frame (1) which consists of two frame parts (2 and 3) and transverse links (4). The frame parts (2 and 3) consist of wooden boards (6) to (9) which define the outline of the frame parts (2 and 3). The frame parts (2, 3) can be stiffened by additional boards (10 to 12) which are arranged to run obliquely. Everywhere the boards which form the frame parts (2 and 3) abut one another they are joined to one another by nail plates (14, 15 and 16). The transverse links (4) which join the frame parts (2 and 3) to one another to form the frame (1) are likewise boards with a length which determines the distance between the frame parts (2 and 3) and the space which is available for heat and/or sound insulation. It is also advantageous that the prefabricated wall panel as claimed in the invention with its frame (1) can be assembled on site.

10 Claims, 1 Drawing Sheet

PREFABRICATED WALL PANEL

The invention relates to a prefabricated wall panel comprising a frame which is provided with a lining on one or both sides.

BACKGROUND OF THE INVENTION

This prefabricated wall panel is known from DE 25 19 469 B. Known prefabricated wall panels, especially those for prefabricated construction, have a frame which is composed of beams, the beams often being joined to one another by means of nail plates to form the frame of the prefabricated wall panel. To save material and weight, in known prefabricated wall panels the frames are produced from beams with a rectangular cross sectional shape, the beams generally being aligned such that the wider side surfaces of the beams are aligned perpendicular to the plane of the prefabricated wall panel. Thus, between the linings of the prefabricated wall panel which are attached to the frame, space is created for the installation of relatively thick insulation. There is however little space available for attachment of nail plates to the narrow side of the beams so that only narrow nail plates can be used. This imparts only little stiffness to the frames of known prefabricated wall panels. Therefore in the known prefabricated wall panels the internal and external lining must contribute to the strength of the prefabricated wall panel.

The disadvantage in the known prefabricated wall panels is therefore that for high transverse loading, for example due to strong wind impact, damage to the prefabricated wall panel (cracking, warping), especially of the linings of the prefabricated wall panel, can arise when the linings of the prefabricated wall panel are not very sturdy, therefore for example, when they are not made with the corresponding wall thickness.

SUMMARY OF THE INVENTION

The object of the invention is to devise remedies here and to make available a prefabricated wall panel of the initially mentioned type in which the frame of the prefabricated wall panel is made stiffer than in known prefabricated wall panels, and in addition there is the possibility of matching the thickness of the prefabricated wall panel to the insulating properties of the prefabricated wall panel which are desired at the time.

This object is achieved as claimed in the invention with a prefabricated wall panel with the features of claim 1.

Preferred and advantageous embodiments of the prefabricated wall panel as claimed in the invention are the subject of the dependent claims.

The prefabricated wall panel as claimed in the invention has a frame which consists of boards. Preferably the frame consists of two frame parts which are aligned at least roughly parallel to one another. These frame parts form for example an inner and an outer frame. The frame parts are interconnected for example via transverse spacing boards. This yields a stiff frame for the prefabricated wall panel as claimed in the invention.

Furthermore, the invention makes it possible to choose the width of the boards which form the frame parts such that there is enough room for connecting elements, for example, nail plates, at the connection locations of the boards which form the frame parts.

The width of the transverse boards which connect the frame parts, for example the inner frame with the outer frame, can be chosen according to the desired insulation action of the prefabricated wall panel so that with the same frame parts (inner frame and outer frame) prefabricated wall panels with different wall thicknesses and accordingly with different thickness of the space which holds the insulation can be built.

It is advantageous in the prefabricated wall panel as claimed in the invention that material and weight are saved, since the boards which form the frame parts need be only roughly 30 to 50 mm thick. Also the transverse boards which join the frame parts to one another generally need not be thicker than 40 to 60 mm.

Another advantage of the prefabricated wall panel as claimed in the invention consists in that the boards which form the frame parts can be joined to one another by large-area nail plates. Thus there arises sufficient stiffness of the two frame parts and the lining of the prefabricated wall panel is no longer decisive for the strength of the prefabricated wall panel.

It is also advantageous that the boards which are joined to one another to form frame parts for example by the nail plates can be delivered to the construction site without their being joined together by the transverse boards and are only joined, for example screwed together, on site with the transverse boards to form the frame. Thus it is possible to use the prefabricated wall panel as claimed in the invention also for independent construction and to install the insulation of the prefabricated wall panel on site. This results not only in easy handling (low weight of the frame parts and the transverse boards), but also saves transport volume.

For larger prefabricated wall panels there can be diagonal reinforcements. This is feasible especially for corner elements and for individual intermediate elements at larger side lengths of walls of the prefabricated wall panels as claimed in the invention.

BRIEF DESCRIPTION OF THE DRAWINGS

Other details, advantages and features of the invention are given in the following description with reference to the drawings.

DETAILED DESCRIPTION OF THE INVENTION

Figure 1:
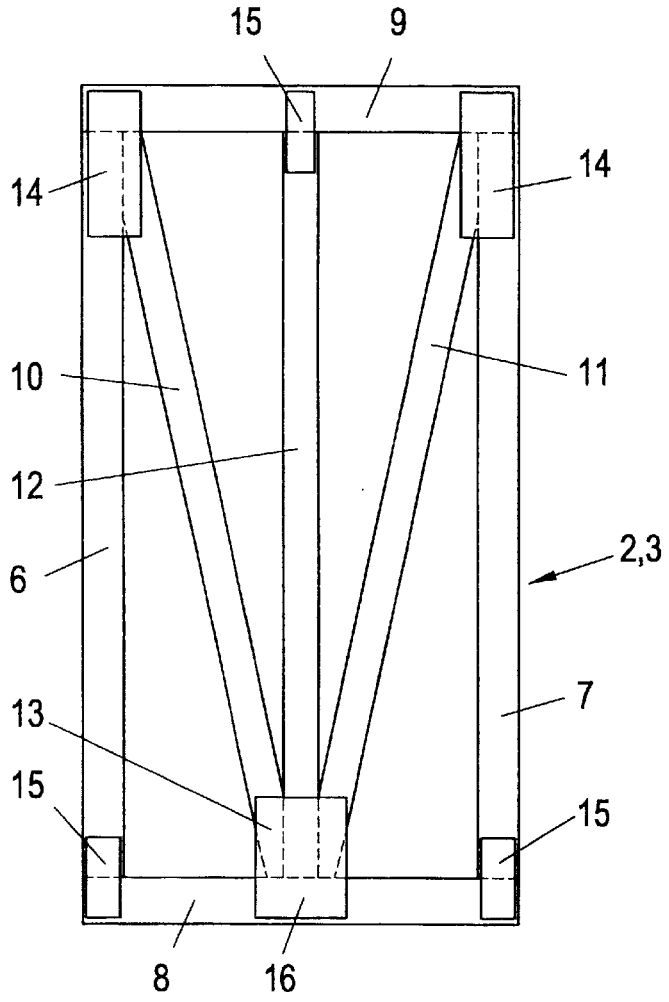
FIG. 1 shows in one view the prefabricated wall panel frame which has not yet been provided with a lining in one embodiment.
Figure 2:
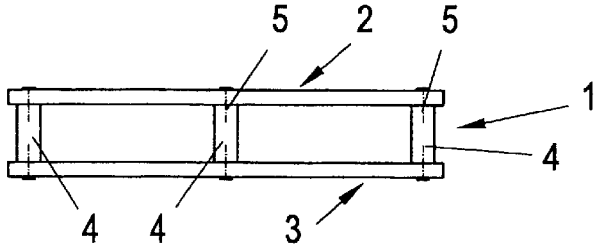
FIG. 2 shows an overhead view of FIG. 1, and FIG. 3 schematically shows a building shell composed of prefabricated wall panels as claimed in the invention.

In the embodiment shown in FIGS. 1 and 2, the prefabricated wall panel as claimed in the invention consists of a frame 1 which has two frame parts 2 and 3 which are spaced apart and which are aligned parallel to one another. The outside surfaces of the frame parts 2 and 3 can be lined with any lining, for example an inside lining and an outside lining in order to form a prefabricated wall panel (ready to use).

The frame parts 2 and 3 are spaced apart and are joined parallel to one another by transverse links 4. The thickness of the frame 1, therefore the distance of the frame parts 2 and 3 from one another, is defined by the length of the transverse links 4 which is measured transversely to the plane of the frame 1.

The transverse links 4 in one preferred embodiment are boards with their end surfaces joined to the frame parts 2 and 3. To connect the frame parts 2 and 3 with the transverse links 4 which are made for example as boards, screws 5 or nails or other connecting elements are used.

In one preferred embodiment both the frame parts 2 and 3 and also the transverse links 4 consist of wooden boards, the boards comprising the frame parts 2 and 3 being for example 30 to 50 mm thick, conversely the boards which form the transverse links 4 can be 40 to 60 mm thick.

FIG. 1 shows that the frame parts 2 and 3 consist first of all of four boards 6, 7 and 8, 9 which form the periphery of the frame parts 2 and 3. The boards 6 to 9 which define the outside periphery of the frame parts 2 and 3 are joined to one another in the corners of the frame parts 2 and 3. Preferably, to join the boards 6, 7 and 8, 9 of the frame parts 2 and 3, plate-shaped connecting elements, for example nail plates 14, 15, are used. Because the boards 6, 7 and 8, 9 can be made wide without their significantly increasing the weight of the frame parts 2 and 3 and thus of the frame 1 of the prefabricated wall panel as claimed in the invention, large-area connecting elements such as (large-area) nail plates can be advantageously placed.

If greater stiffness of the frame 1 is desired, the frame parts 2 and 3 can be stiffened by additional boards 10, 11, and 12 which are provided within the frame. In one preferred embodiment the boards 10, 11 and 12 are arranged as shown in FIG. 1, and run from one junction 13 in the area of the lower horizontal board 8 radially away from one another and (boards 10 and 11) to the opposite corners and (board 12) towards the center of the opposite board 9. Also the boards 10, 11 and 12 which stiffen the frame parts 2 and 3 can be joined by plate-shaped connecting elements 15, 16, preferably nail plates, to the boards 6, 7, 8 and 9 which define the periphery of the frame parts 2 and 3. Here it is preferable that the ends of the diagonally running boards, such as boards 10, 11 which end in the internal corners of the frame parts 2 and 3, are fixed by nail plates 14 which also connect the transversely running board 9 to the lengthwise boards 6 and 7. FIG. 1 shows that the nail plates 14 are made wider and longer than the nail plates 15 in the corners without the ends of diagonal boards 10, 11. The nail plate 16 in the area of the junction 13 is likewise made larger than the nail plates 15.

Nail plates or other plate-shaped connecting elements can also be provided on one side on the frame parts 2, 3 or, if desired, also on both sides.

Figure 3:
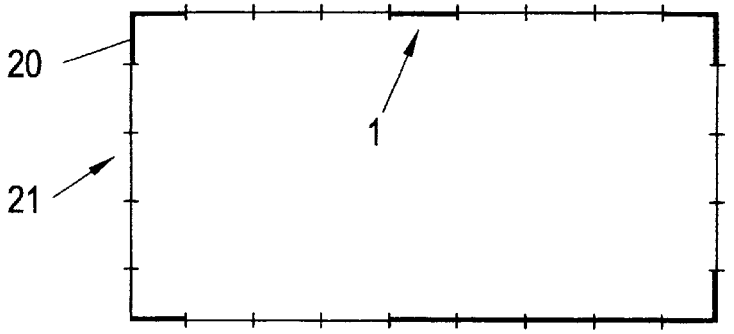

The frame 1 for prefabricated wall panels with optionally stiffened frame parts 2 and 3 as shown in FIG. 1 are intended especially for corner elements 20 of building shells 21 as shown in FIG. 3. In the same way frames 1 with stiffened frame parts 2 and 3 can be provided in the walls which have a greater length in order to impart greater stiffness to the entire building shell.

In summary, one preferred embodiment of the invention can be described as follows:

A prefabricated wall panel for wood structures has a frame 1 which consists of two frame parts 2 and 3 and transverse links 4. The frame parts 2 and 3 consist of wooden boards 6 to 9 which define the outline of the frame parts 2 and 3. The frame parts 2, 3 can be stiffened by additional boards 10 to 12 which are arranged to run obliquely. Everywhere the boards which form the frame parts 2 and 3 abut one another they are joined to one another by nail plates 14, 15 and 16. The transverse links 4 which join the frame parts 2 and 3 to one another to form the frame 1 are likewise boards with a length which determines the distance between the frame parts 2 and 3 and the space which is available for heat and/or sound insulation. It is also advantageous that the prefabricated wall panel as claimed in the invention with its frame 1 can be assembled on site.

What is claimed is:

1. A prefabricated wall panel for prefabricated construction, comprising:

a frame having a lining on at least one side;

said frame being made as a double frame with rectangular outline which has two frame parts which are parallel to one another and spaced apart;

each frame part being formed from short boards and from long boards, which together define the periphery of the respective frame part; the frame parts being joined together by transverse links;

said boards which form the respective frame part being joined to one another in corner areas by plate-shaped connecting elements;

at least two stiffening boards for stiffening a respective frame part; each stiffening board having two ends joined to the boards which define the periphery of the respective frame part by plate-shaped connectors;

said stiffening boards being aligned to run obliquely to the long boards proceeding from one junction in an area of one short board to opposite corners of the respective frame part and to pass through the frame in the direction of its length which is measured parallel to the long boards.

2. The prefabricated wall panel according to claim 1, wherein the transverse links are wooden boards.

3. The prefabricated wall panel according to claim 1, wherein the short and long boards are made out of wood.

4. The prefabricated wall panel according to claim 1, wherein the stiffening boards are made out of wood.

5. The prefabricated wall panel according to claim 1, wherein the plate-shaped connecting elements are nail plates.

6. The prefabricated wall panel according to claim 1, wherein the plate-shaped connectors are nail plates.

7. The prefabricated wall panel according to claim 1, further comprising at least one reinforcing board running parallel to the long boards of the frame parts and joined to the short boards which run transversely.

8. The prefabricated wall panel according to claim 7, wherein said reinforcing board is positioned to run from the junction, bisecting the angle formed by the two obliquely running boards, to the center of the opposite transversely running short board.

9. The prefabricated wall panel according to claim 7, wherein the reinforcing board is made out of wood.

10. The prefabricated wall panel according to claim 1, wherein the frame parts are screwed to the transverse links.

* * * * *